US011322054B2

(12) United States Patent
Park et al.

(10) Patent No.: US 11,322,054 B2
(45) Date of Patent: May 3, 2022

(54) FLEXIBLE COVER WINDOW

(71) Applicant: UTI INC., Chungcheongnam-do (KR)

(72) Inventors: Deok Young Park, Gyeonggi-do (KR); Jae Young Hwang, Gyeonggi-do (KR); Hak Chul Kim, Chungcheongnam-do (KR); Kukhyun Sunwoo, Gyeonggi-do (KR); Tea Joo Ha, Chungcheongnam-do (KR)

(73) Assignee: UTI INC.

( * ) Notice: Subject to any disclaimer, the term of this patent is extended or adjusted under 35 U.S.C. 154(b) by 92 days.

(21) Appl. No.: 16/856,078

(22) Filed: Apr. 23, 2020

(65) Prior Publication Data

US 2020/0342789 A1 Oct. 29, 2020

(30) Foreign Application Priority Data

Apr. 26, 2019 (KR) ..... 10-2019-0049109

(51) Int. Cl.
*G09F 9/30* (2006.01)

(52) U.S. Cl.
CPC ..... *G09F 9/301* (2013.01)

(58) Field of Classification Search
CPC ..... G09G 9/301; G06F 1/1641; G06F 1/1652; G02B 1/14; G09F 9/301
See application file for complete search history.

(56) References Cited

U.S. PATENT DOCUMENTS 11,064,620 B2 * 7/2021 Shin ..... B32B 27/283
2014/0132488 A1 * 5/2014 Kim ..... G06F 1/1637 345/76
2016/0147264 A1 * 5/2016 Kil ..... G06F 1/163 345/173
2016/0188098 A1 * 6/2016 Her ..... G06F 3/04164 345/173
2017/0192462 A1 * 7/2017 Kim ..... B32B 27/28
2018/0059822 A1 * 3/2018 Seo ..... G06F 3/0447
2018/0096635 A1 * 4/2018 Park ..... H01L 51/0097
2018/0132371 A1 * 5/2018 Yeum ..... G06F 1/1652
2018/0364759 A1 * 12/2018 Ahn ..... G06F 1/1616
2019/0080634 A1 * 3/2019 Mao ..... G02F 1/133305
2019/0173030 A1 * 6/2019 Kim ..... B32B 7/12
(Continued)

FOREIGN PATENT DOCUMENTS

KR 20160083789 A * 7/2016
KR 1020160083789 A 7/2016
(Continued)

*Primary Examiner* — Joe H Cheng

(74) *Attorney, Agent, or Firm* — Mendelsohn Dunleavy, P.C.

(57) ABSTRACT

A cover window is proposed. Particularly, a flexible cover window having improved visibility for a flexible display is proposed, the flexible cover window including: a first window made of glass and provided on an upper part of a first surface of the flexible display; a second window made of glass and provided on an upper part of a second surface of the flexible display; and a folding part provided between the first window and the second window by corresponding to a folding area of the display and filled with a transparent resin material, wherein a transparent resin layer is provided on a total surface of each of the first window and the second window by continuing to the folding part filled with the transparent resin material.

20 Claims, 7 Drawing Sheets

(56) References Cited

U.S. PATENT DOCUMENTS

| | | | | |
|---|---|---|---|---|
| 2020/0139672 | A1* | 5/2020 | Cao | B32B 27/06 |
| 2020/0292731 | A1* | 9/2020 | Park | G02B 1/14 |
| 2020/0310494 | A1* | 10/2020 | Ahn | G06F 3/041 |
| 2020/0324521 | A1* | 10/2020 | Park | B32B 17/10146 |
| 2020/0329575 | A1* | 10/2020 | Park | G06F 1/1652 |
| 2020/0392038 | A1* | 12/2020 | Park | C03C 21/002 |
| 2021/0002947 | A1* | 1/2021 | Park | E06B 3/28 |
| 2021/0107826 | A1* | 4/2021 | Hwang | C03C 15/00 |
| 2021/0191467 | A1* | 6/2021 | Sunwoo | G06F 1/1656 |
| 2021/0282285 | A1* | 9/2021 | Sunwoo | B32B 3/30 |

FOREIGN PATENT DOCUMENTS

| | | | |
|---|---|---|---|
| KR | 1020170026747 | A | 3/2017 |
| KR | 1020170080446 | A | 7/2017 |
| KR | 1020170122554 | A | 11/2017 |

* cited by examiner

FLEXIBLE COVER WINDOW

CROSS REFERENCE TO RELATED APPLICATION

The present application claims priority to Korean Patent Application No. 10-2019-0049109, filed Apr. 26, 2019, the entire contents of which is incorporated herein for all purposes by this reference.

BACKGROUND OF THE INVENTION

Field of the Invention

The present invention generally relates to a flexible cover window. More particularly, the present invention relates to a flexible cover window, in which visibility of a boundary part of a folding part, that is, visibility of a boundary part to the naked eye due to the reflection of a boundary surface of glass is minimized, and strength and folding properties are secured.

Description of the Related Art

Recently, electric and electronic technologies have been rapidly developed, and various types of display products are released to meet demands of a new era and various consumer demands. Among them, research on a flexible display in which the screen can be folded and unfolded is active.

The research on the flexible display is being conducted by bending, rolling, and stretching the display, fundamentally starting from folding the display. In addition to a display panel, a cover window protecting the display panel is also required to be formed flexibly.

Such a flexible cover window is required to fundamentally have excellent flexibility, and to have no marks on a folding part and no distortion of image quality even after being repeatedly folded.

The cover window of a conventional flexible display has used a polymer film such as a PI or PET film on a display panel surface.

However, since such a polymer film is weak in mechanical strength, the polymer film serves only to prevent scratches of the display panel and is vulnerable to external impacts. Furthermore, the polymer film has a low transmittance and is known to be relatively expensive.

In addition, in the case of the polymer film, as the number of times the display is folded increases, marks remain on the folding part, which inevitably damages the folding part. For example, the polymer film is pressed or torn during folding limit evaluation (usually 200,000 times).

Recently, a research on a glass-based cover window has been conducted to overcome the limitation of the cover window provided with the polymer film.

As a prior art for such a glass-based cover window, there is "Foldable display device" (Korean Patent Application Publication No. 10-2017-0122554), which provides a cover window formed to be thin in a folding part.

The thickness of the cover window according to the prior art is formed to become thicker as distance from a folding line defined as having the minimum thickness increases. That is, the folding part of the cover window according to the prior art in which a minimum thickness area is defined as a line shows a curved shape.

As for the prior art, the minimum thickness area of the folding part appears as a relatively small line (the folding line). In this case, when folding is repeated, thick parts break during the folding.

As for the folding part having a curved shape, it is not easy to align its center during mechanical assembly, so assembly tolerances may occur, which may result in deterioration of product quality and quality difference between products.

As for the prior art, the folding part having the thin portion formed in the cover window is bonded to the display panel, which is a flat plate. In this case, space (an air layer) is formed between the folding part and the surface of the display panel, which causes the problem of distortion of image quality due to difference in a refractive index between glass and the air layer. Furthermore, the folding part is damaged due to the pressure of a touch pen or is lowered in durability since a bonding force between portions adjacent to the folding part and the display panel is decreased.

Accordingly, the glass-based cover window is required to satisfy the folding properties and fundamentally required properties such as no distortion of image quality and sufficient strength to withstand the repeated touching and certain pressure of a touch pen. To satisfy the strength property of the cover window, the glass is required to have at least a predetermined thickness, and to satisfy the folding properties, the glass is required to have a predetermined thickness or less. Accordingly, research on the thickness and structure of an optimum cover window, which satisfies the folding properties while satisfying the strength property and has no distortion of image quality, is needed.

Furthermore, when glass has a predetermined thickness or less, intrinsic texture of tempered glass decreases, so this is also required to be taken into account.

Accordingly, a technique for providing the cover window is needed, in which appropriate thickness is maintained to secure strength while maintaining the intrinsic texture of tempered glass and the folding properties are also satisfied.

Due to such a need, the present applicant has filed a "Flexible cover window" (Korean Patent Application No. 10-2019-0027399).

The prior art provides a glass-based cover window for a flexible display, and includes a folding part slimmed by corresponding to a folding area of the display. Here, as illustrated in FIG. 1, a boundary part is formed on opposite ends of the folding part, the boundary part having a thickness gradually becoming larger from the folding part and continuing to a plane area of the cover window. The boundary part is visible to the naked eye due to the reflection of light. Accordingly, visibility of the cover window may decrease.

FIG. 2 illustrates a case in which a reflective surface of the boundary part between the folding part and the plane area is visible to the naked eye, which causes distortion of a screen and reduces resolution of a screen. This problem is required to be improved when the flexible cover window is applied.

SUMMARY OF THE INVENTION

Accordingly, the present invention has been made keeping in mind the above problems occurring in the related art, and the present invention is intended to propose a flexible cover window in which visibility is improved, and strength and folding properties are secured while the intrinsic texture of glass is maintained.

In order to achieve the above objectives, according to one aspect of the present invention, there is provided a flexible cover window having improved visibility for a flexible display, the flexible cover window including: a first window made of glass and provided on an upper part of a first surface of the flexible display; a second window made of glass and provided on an upper part of a second surface of the flexible display; and a folding part provided between the first window and the second window by corresponding to a folding area of the display and filled with a transparent resin material, wherein a transparent resin layer is provided on a total surface of each of the first window and the second window by continuing to the folding part filled with the transparent resin material.

In addition, each of the first window and the second window may have an inclined part configured to have a thickness gradually becoming smaller toward the folding part, the inclined part, the inclined part may be provided on a surface or opposite surfaces of each of the first window and the second window, and inclination of the inclined part may be 1~10° relative to a horizontal direction of the cover window.

Furthermore, each of an end part of the first window and an end part of the second window, which are in contact with the folding part, may have a polished surface.

Additionally, the transparent resin layer may be provided on a surface of each of the first window and the second window, or on a total surface of opposite surfaces thereof, or on a total surface of front, back, and side surfaces thereof to completely cover the first window and the second window inside the transparent resin layer.

In addition, in the transparent resin layer, the transparent resin layer provided on the back surface of each of the first window and the second window may be made of a material softer than a material of the transparent resin layer provided on the front surface of each of the first window and the second window.

Furthermore, the inclined part may be provided by any one process of wet etching, polishing, laser forming, and masking processes, or by a process of combining at least two processes thereof, or by the wet etching, the laser forming, or the masking process, which is followed by the polishing process.

Additionally, the transparent resin material may be an optical clear resin (OCR).

In addition, the flexible cover window may further include a functional coating layer provided on a surface or opposite surfaces of the cover window, and the functional coating layer may be configured as a single layer or multiple layers.

Furthermore, a functional coating layer provided on a front surface of the cover window may be embodied as a strength reinforcement layer, and a functional coating layer provided on a back surface of the cover window may be embodied as an elastic reinforcement layer. When the functional coating layer provided on the front surface of the cover window is configured as multiple layers, the functional coating layer may be made of a material becoming harder upward. Additionally, a functional coating layer provided on an uppermost layer may be given an anti-finger (AF) or an anti-reflective (AR) function.

A thickness of each of the first window and the second window according to the present invention may be 20 to 50 μm; the cover window may satisfy a minimum curvature radius of 0.5 to 2.5 mm during folding; and a width ($W_1$) of the folding part may be 3.0 to 8.0 mm.

The present invention generally relates to the flexible cover window. More particularly, the present invention relates to the flexible cover window, in which the visibility of the boundary part of the folding part, that is, the visibility of the boundary part to the naked eye due to the reflection of the boundary surface of glass is minimized, and strength and folding properties are secured.

In addition, the flexible cover window according to the present invention is made of a composite material of glass and a resin material, so that flexibility, resilience, elasticity, and strength properties are reinforced due to the resin material while the optical properties and texture of glass are maximally maintained.

Furthermore, according to the flexible cover window of the present invention, the limitation of the thickness of the folding part due to the use of the existing glass is minimized due to the use of the composite material of glass and a resin material, so folding and strength properties are improved.

Accordingly, since there is no limitation of the thickness in the folding part, stress difference due to difference of the thickness of glass between a plane area and a folding area can be overcome, so the distortion of a screen or the deterioration of the resolution and durability thereof can be minimized and thus a high quality flexible display can be provided.

That is, the flexible cover window has high transmittance due to optical properties unique to glass, and can resist scratches and absorb external impact due to the securing of mechanical strength, so that a display panel has excellent visibility and impact resistance.

In addition, the folding part of the flexible cover window according to the present invention is filled with the transparent resin material and the transparent resin layer is formed on the total surface of the first window and the second window by continuing to the folding part so as to have no gap between the folding part and the total surface of the display. Accordingly, the distortion of display image quality can be minimized, the decrease of touch response speed and the decrease of bonding strength between the display and the cover window can be overcome, and the assembly tolerances between the cover window and the display panel can be minimized, thereby minimizing quality differences between products.

Additionally, the flexible cover window of the present invention has improved strength and folding properties while being thin and can be used to protect a clear polyimide (CPI) cover by being disposed thereon.

BRIEF DESCRIPTION OF THE DRAWINGS

The above and other objects, features, and other advantages of the present invention will be more clearly understood from the following detailed description when taken in conjunction with the accompanying drawings, in which.

DETAILED DESCRIPTION OF THE INVENTION

Figure 1:
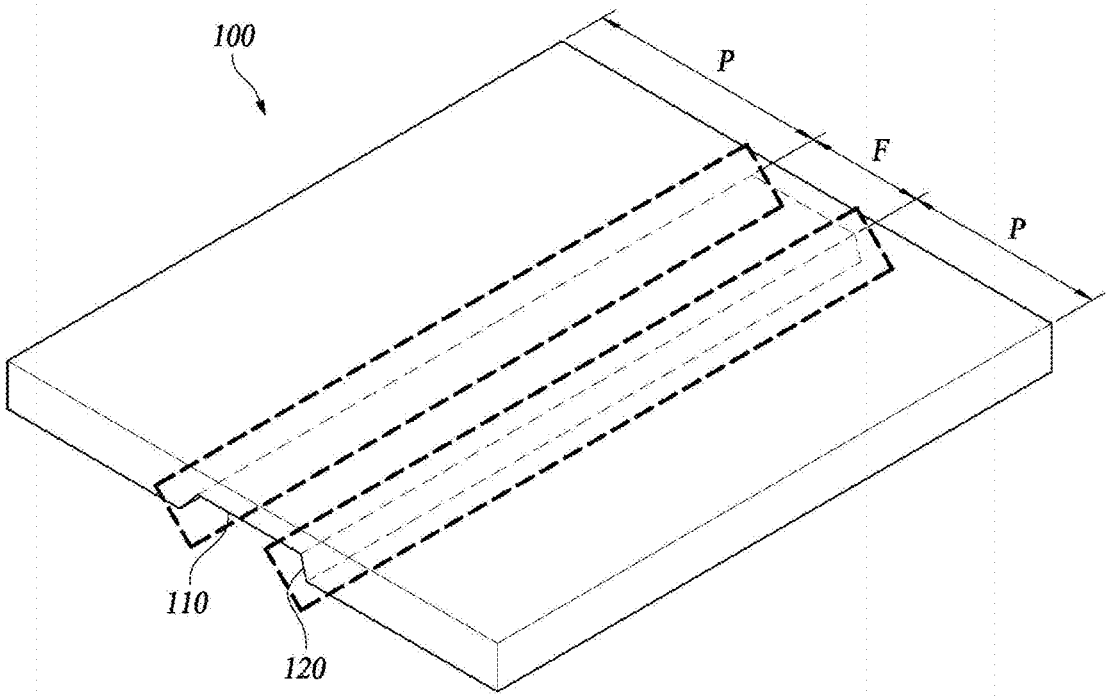
FIG. 1 is a view illustrating an existing flexible cover window.
Figure 2:
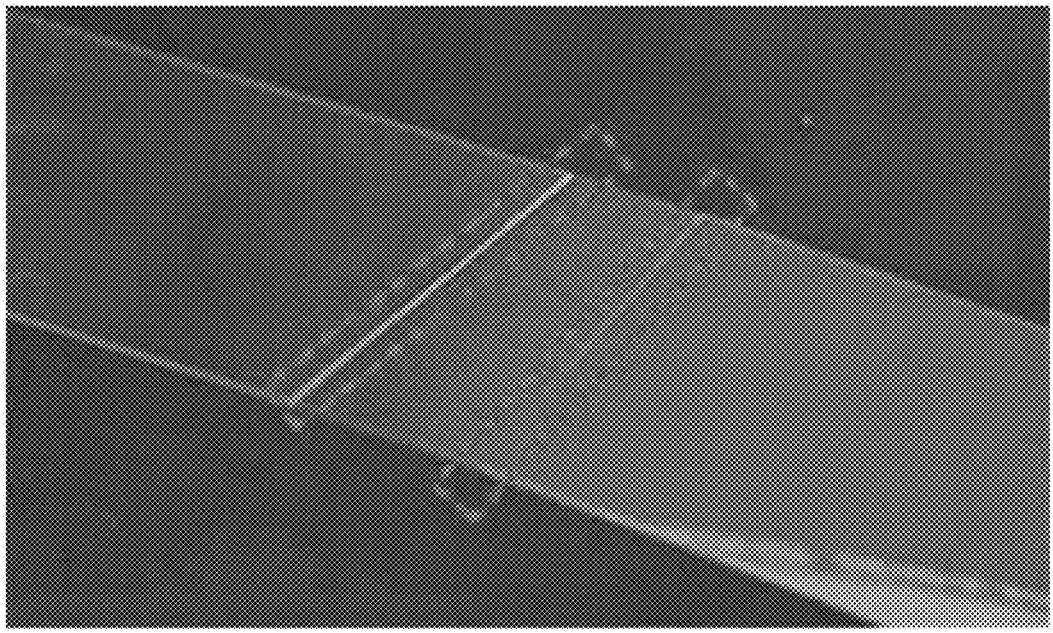
FIG. 2 is a view illustrating the visibility of a boundary part between a folding part and a plane area of the existing flexible cover window.

The present invention generally relates to a flexible cover window. More particularly, the present invention relates to a flexible cover window, in which visibility of a boundary part of a folding part, that is, visibility of a boundary part to the naked eye due to the reflection of a boundary surface of glass is minimized, and strength and folding properties are secured.

In addition, the flexible cover window according to the present invention is made of a composite material of glass and a transparent resin material, so that flexibility, resilience, elasticity, and strength properties are reinforced due to the resin material while the texture of glass is maximally maintained.

Furthermore, according to the flexible cover window of the present invention, the limitation of the thickness of the folding part due to the use of the existing glass is minimized due to the use of the composite material of glass and the resin material, so folding and strength properties are improved.

Accordingly, since there is no limitation of the thickness in the folding part, stress difference due to difference of the thickness of glass between a plane area and a folding area can be overcome, so the distortion of a screen or the deterioration of the resolution and durability thereof can be minimized and thus a high quality flexible display can be provided.

Hereinbelow, the embodiments of the present invention will be described with reference to the accompanying drawings. FIGS. 3A to 8 are views illustrating various embodiments of the flexible cover window according to the present invention.

As illustrated in the drawings, the cover window having improved visibility for a flexible display according to the present invention includes: a first window 110 made of glass and provided on an upper part of a first surface of the flexible display; a second window 120 made of glass and provided on an upper part of a second surface of the flexible display; and the folding part 130 provided between the first window 110 and the second window 120 by corresponding to a folding area of the display and filled with a transparent resin material, wherein a transparent resin layer 150 is provided on a total surface of each of the first window 110 and the second window 120 by continuing to the folding part 130 filled with the transparent resin material.

The flexible display according to the present invention is folded in at least any one portion, and one surface of the display is referred to as a first surface, and the other surface is referred to as a second surface with the folding part as a boundary. As required, the folding part may be two or more parts, and in this case, the folding parts may be embodied as a third surface, a fourth surface, or the like, with the folding parts as boundaries. Accordingly, a third window, a fourth window, etc. may be formed correspondingly.

In addition, in the present invention, a back surface of each of the first window 110 and the second window 120 refers to a surface bonded to a display panel, and a front surface thereof refers to an upper surface of the flexible cover window 100 which a user can touch or recognize. That is, a portion folded relative to the folding part 130 is the front surface and a portion stretched relative thereto is the back surface.

Furthermore, "a total surface" refers to a surface of an entire area, and may include upper, lower, and side surfaces in some cases. In the present invention, "a total surface of a display panel" usually refers to a surface of an entire area of the front surface of the display panel.

Accordingly, the present invention provides the cover window 100 which is provided on the total surface of the display panel to maintain the folding properties and strength while protecting the display panel. Furthermore, the cover window 100 according to the present invention can be used to protect a clear polyimide (CPI) cover by being disposed on the CPI cover.

The present invention relates to the flexible cover window 100 bonded to such a flexible display, and the flexible cover window is made of a composite material that utilizes the advantages of glass and the resin material. Particularly, the folding area is made only of the resin material, so the visibility of the boundary part of the folding part 130, that is, the visibility of the boundary part to the naked eye due to the reflection of the boundary surface of glass is minimized, and the thickness limitation of the cover window 100 for improving folding properties is not required, so that processing the cover window is easy and folding and strength properties can be improved.

Such a flexible cover window according to the present invention 100 includes: the first window 110 made of glass and provided on the upper part of the first surface of the flexible display; the second window 120 made of glass and provided on the upper part of the second surface of the flexible display; and the folding part 130 provided between the first window 110 and the second window 120 by corresponding to the folding area of the display and filled with the transparent resin material.

That is, the flexible cover window according to the present invention 100 is composed of two pieces, which are the first window 110 and the second window 120. The first window 110 and the second window 120 are spaced apart from each other by an interval corresponding to the folding area to form the folding part 130. The folding part 130 is filled with the transparent resin material, so that the thickness of the cover window 100 in the folding part 130 is not limited, and the folding properties are also improved.

In addition, the folding part 130 is filled with the transparent resin material, and the transparent resin layer 150 is formed on the total surface of each of the first window 110 and the second window 120 by continuing to the folding part 130 filled with the transparent resin material.

Accordingly, the flexible cover window according to the present invention 100 includes the first window 110, the second window 120, and the folding part 130 filled with the transparent resin material, and the transparent resin layer 150 is formed to cover the first window 110 and the second window 120 by continuing to folding part 130 filled with the transparent resin material.

Such a transparent resin layer 150 is formed on a surface of each of the first window 110 and the second window 120 or on a total surface of opposite surfaces thereof, or on the total surface of front, back, and side surfaces thereof to completely cover the first window 110 and the second window 120 inside the transparent resin layer 150.

That is, the first window 110 and the second window 120, which are made of glass, including the folding part 130 may be provided by being surrounded by the transparent resin layer 150, or as required, the transparent resin layer 150 may be formed only on a surface of the first window 110 and the second window 120.

Here, the material of the transparent resin layer 150 is the same as the transparent resin material. Filling the folding part 130 with the transparent resin material and coating the first window 110 and the second window 120 are performed at the same time, or as required, the folding part 130 may be first filled with the transparent resin material, and the transparent resin layer 150 may be formed by the coating with another material, for example, by the coating with a resin material harder or softer than the transparent resin material, with which the folding part 130 is filled.

Accordingly, according to the flexible cover window 100 made of the composite material, the first window 110 and the second window 120 are configured by being spaced apart from each other by the interval corresponding to the folding area, and the spaced part is filled with the transparent resin material to form the folding part 130, and the transparent resin layer 150 is formed on a surface or opposite surfaces of each of the first window 110 and the second window 120 by continuing to the folding part 130, so the first window 110 and the second window 120 made of glass may be arranged inside the transparent resin layer 150, and the folding part 130 filled with the transparent resin material is provided therebetween. Alternatively, the first window 110 and the second window 120 may be arranged on an upper part or a lower part of the transparent resin layer 150 and the folding part 130 filled with the transparent resin material may be arranged therebetween.

Furthermore, the transparent resin layer 150 is formed on the surface of each of the first window 110 and the second window 120 or on the total surface of the opposite surfaces thereof. Accordingly, when the cover window is bonded to the display panel, the cover window is in close contact with the display panel such that there is no empty space therebetween, thereby minimizing screen distortion caused by difference in refractive index due to the presence of an air layer, or a floating phenomenon of the cover window 100.

In addition, the transparent resin layer 150 is formed on the total surface of front, back, and side surfaces of each of the first window 110 and the second window 120 to completely cover the first window 110 and the second window 120 inside the transparent resin layer 150. Accordingly, the first window 110 and the second window 120 are included inside the transparent resin layer 150, and even the side surfaces of the first window 110 and the second window 120 can be protected by the transparent resin material.

Here, when the transparent resin layer 150 is formed to surround the opposite surfaces or the total surface of each of the first window 110 and the second window 120, a transparent resin layer 150 formed on the back surface of each of the first window 110 and the second window 120 is formed of a material softer than a material of a transparent resin layer 150 formed on the front surface of each of the first window 110 and the second window 120.

A portion which a user touches has the transparent resin layer 150 formed of a relatively hard material to maintain durability. The folded portion is formed of a hard material, and the stretching portion is formed of a relatively soft material to minimize cracks at the stretching portion.

An optical clear resin (OCR) having a refractive index almost identical to a refractive index (1.5) of glass is used as such a transparent resin material. For example, acrylic, epoxy, silicone, urethane, urethane compound, urethane acryl compound, hybrid sol gel, and siloxane family may be used. The combination of the resin materials is variously performed according to characteristics of the resin materials and can be used for reinforcing strength and elasticity.

Accordingly, in the flexible cover window according to the present invention 100, the folding part 130 is not made of a glass material, but is made of the resin material, so the visibility of the boundary part of the folding part 130, that is, the visibility of the boundary part to the naked eye due to the reflection of the boundary surface of glass is minimized, and folding properties are improved. Furthermore, the flexible cover window according to the present invention is made of the composite material of glass and a resin material, so that flexibility, resilience, elasticity, and strength properties are reinforced due to the resin material while the optical properties and texture of glass are maximally maintained.

In addition, the folding part 130 of the flexible cover window according to the present invention is filled with the transparent resin material, and the transparent resin layer 150 is formed on the front surface of each of the first window 110 and the second window 120 by continuing to the folding part 130 so as not to form a gap between the cover window and the front surface of the display. Accordingly, the distortion of display quality can be minimized, the decrease of touch response speed and the decrease of bonding strength between the display and the cover window can be overcome, and the assembly tolerances between the cover window and the display panel can be minimized, thereby minimizing quality differences between products.

Meanwhile, each of the first window 110 and the second window 120 according to the present invention may have an inclined part 140 configured to have thickness gradually becoming smaller toward the folding part 130. The inclined part 140 may be formed on the surface or opposite surfaces of each of the first window 110 and the second window 120.

The inclined part 140, which is formed to be adjacent to the folding part 130, functions to buffer difference of tensile stress caused by folding and to minimize the visibility of the boundary part of the folding part 130, that is, the visibility of the boundary part to the naked eye due to the reflection of the boundary surface of the side surface of a glass.

Here, to minimize the reflection of the boundary surface of the side surface of glass, the inclination of the inclined part 140 is preferably 1~10° relative to the horizontal direction of the cover window 100. This is to minimize the reflection of the boundary surface in contact with the folding part 130 while the texture of glass of the first window 110 and the second window 120 is maximally maintained so that the resolution difference or distortion of a screen is minimized.

The inclined part 140 can be formed by any one process of wet etching, polishing, laser forming, and masking processes, or by a process of combining at least two processes thereof, or by the wet etching, the laser forming, or the masking process, which is followed by the polishing process As for the first window 110 and the second window 120 according to the present invention, to further minimize the reflection of the boundary surface, the end part of each of the first window 110 and the second window 120 in contact with the folding part 130 preferably has a polished surface.

That is, each of the edges of the end parts has a polished surface having a smooth curved surface to minimize the boundary surface of each of the first window 110 and the second window 120 so that the reflection of the boundary surface is minimized. Accordingly, the visibility of the boundary part is deteriorated.

Such a polished surface may be formed simultaneously or sequentially with the process of forming the inclined part 140, and can be formed by any one process of wet etching, polishing, laser forming, and masking processes, or by a process of combining at least two processes thereof, or by the wet etching, the laser forming, or the masking process, which is followed by the polishing process.

Figure 6A:
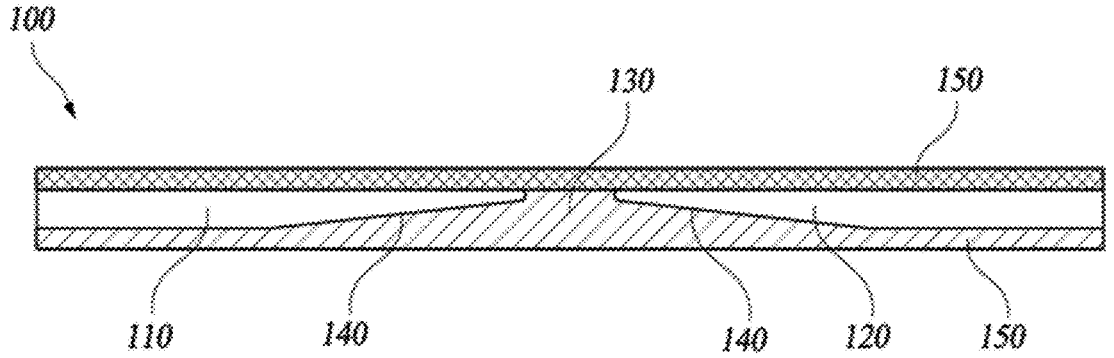
Figure 6B:
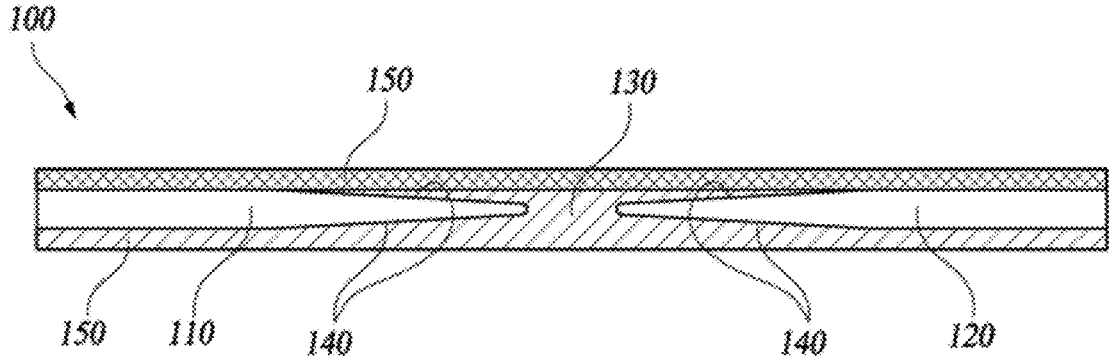
Figure 7:
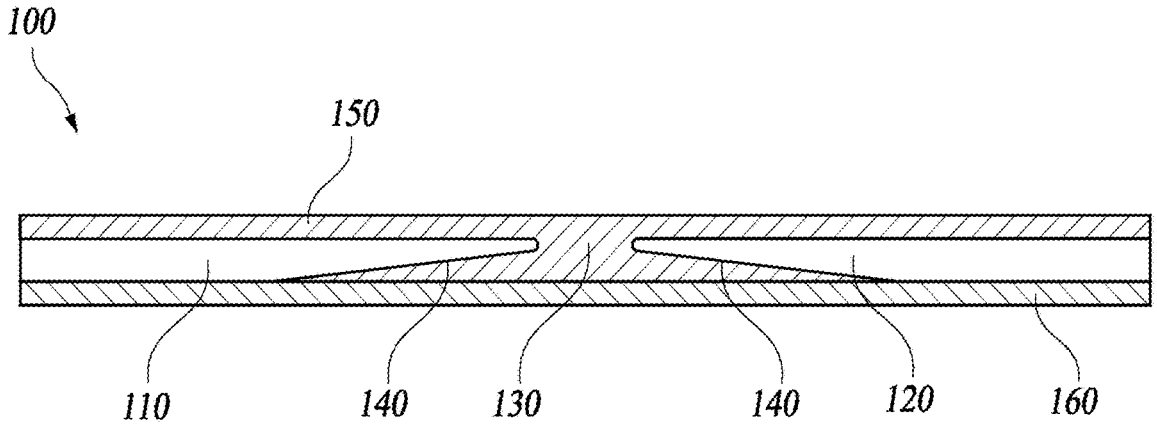

In addition, according to the flexible cover window 100 of the present invention, as illustrated in FIGS. 6A, 6B, and 7, a functional coating layer 160 may further be provided on the surface or the opposite surfaces of the cover window 100. The functional coating layer 160 is formed of a transparent material such as the transparent resin material described above and has functionality by synthesizing a resin having a variety of properties.

When the folding part 130 is filled with the transparent resin material or when the transparent resin layer 150 is formed on the folding part 130 and the total surface of the cover window 100, the functional coating layer may be formed on an upper layer thereof. This can be formed by a known resin coating method such as spraying, dipping, and spin coating.

The functional coating layer 160 can be formed in a single layer or multiple layers. The functional coating layer 160 formed on the front surface of the cover window 100 may be embodied as a strength reinforcement layer, and the functional coating layer 160 formed on the back surface of the cover window 100 may be embodied as an elastic reinforcement layer.

That is, since the front surface of the cover window 100 is touched, the functional coating layer 160 having a reinforced strength may be embodied in the front surface. The functional coating layer 160 having a reinforced elasticity may be embodied on the back surface of the cover window 100 to perform buffering between the back surface and the display panel.

The strength reinforcement layer (hard coating) of the front surface of the cover window 100 uses resin having relatively high hardness when the resin is hardened, for example, resin having a high content of resin such as acrylic or epoxy, and the elastic reinforcement layer (soft coating) of the back surface of the cover window 100 uses resin having relatively high elasticity when the resin is hardened, for example, resin having a high content of silicone or urethane synthetic resin. Furthermore, strength or elasticity is reinforced to be used by controlling the content of organic and inorganic materials in organic-inorganic hybrid sol-gel.

In addition, when the functional coating layer 160 provided on the front surface of the cover window 100 is configured as multiple layers, the functional coating layer 160 is preferably formed of a material getting harder upward.

Furthermore, the functional coating layer 160, particularly, a functional coating layer 160 formed on an uppermost layer may be given an anti-finger (AF) or an anti-reflective (AR) function, and may be embodied by synthesizing a resin having such a function or by forming various patterns, for example, patterns such as moth eyes on the functional coating layer 160.

Accordingly, the cover window 100 according to the present invention may have the functional coating layer 160 formed additionally thereon to reinforce strength and elasticity, so the protection of the cover window 100 from external impacts or the pressure of a touch pen may further be reinforced.

In addition, the functional coating layer 160 further prevents cracking in the folding area, and reinforces the elastic force of the cover window 100 on a surface in contact with the display panel, thereby functioning to improve impact resistance and prevent splintering.

Meanwhile, the cover window 100 of the present invention is used after receiving chemical tempering treatment and is formed to have the thickness of about 20 to 50 μm. The thickness of the entirety of the cover window 100 may be different according to product specifications, and is determined according to the thickness of the transparent resin layer 150. Generally, the transparent resin layer 150 may be configured to have the thickness of 1 to 150 μm.

The width of the folding part 130 is designed in consideration of a curvature radius of the cover window when the cover window 100 is folded, and is approximately 3.0 to 8.0 mm, which is produced by the curvature radius×π. The curvature radius is at least 0.5~2.5 mm during the folding. This is an optimal design for securing the thickness of the glass such that the intrinsic texture of the tempered glass is maintained and for securing the strength and the folding properties thereof at the same time.

Figure 3A:
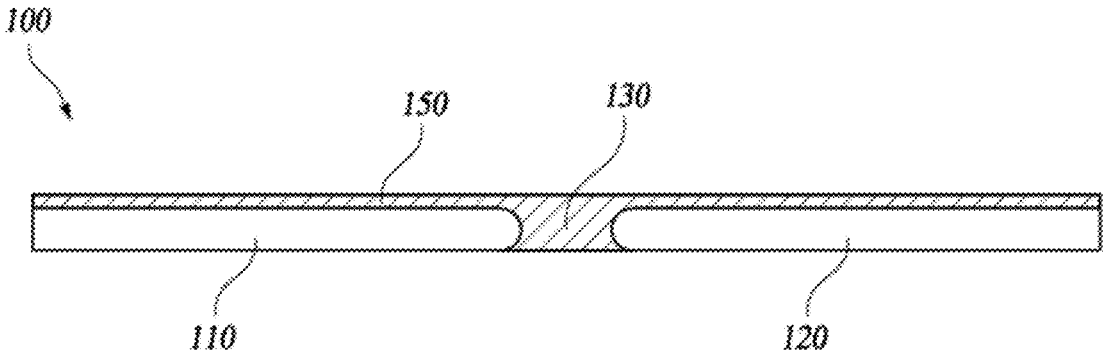
FIGS. 3A, 3B, 3C, 4, 5A, 5B, 6A, 6B, 7, 8, and 9 are views illustrating various embodiments of a flexible cover window according to the present invention.
Figure 3B:
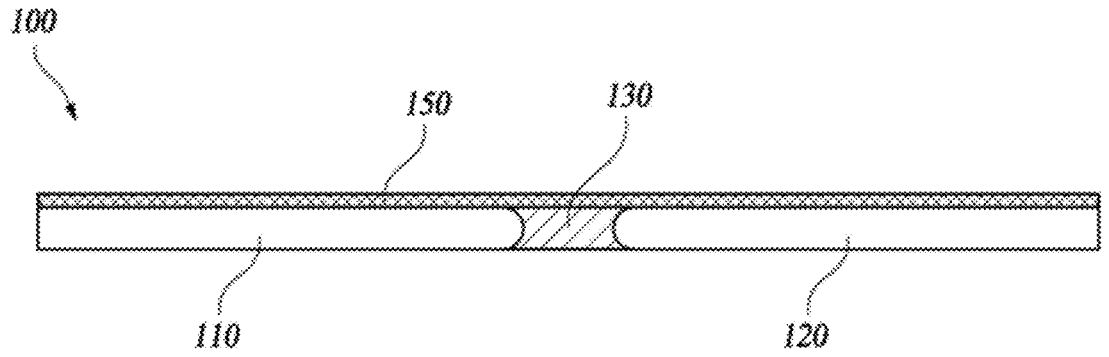
Figure 3C:
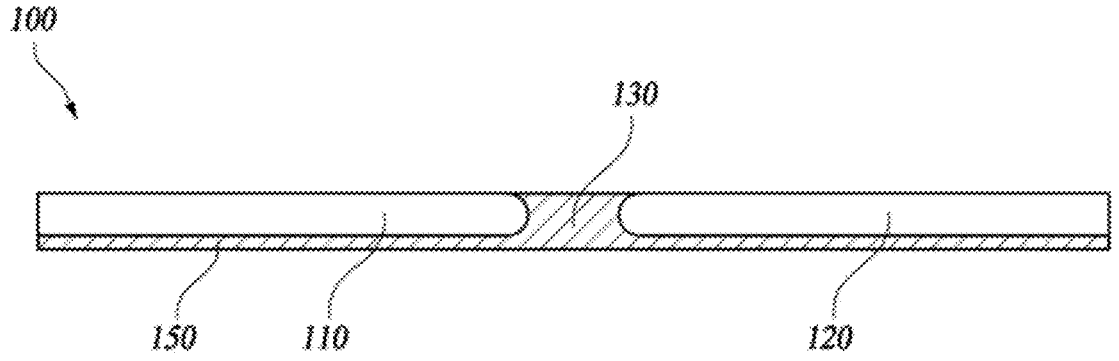

FIGS. 3A, 3B, and 3C illustrate the first window 110 and the second window 120 having overall uniform thickness according to an embodiment of the present invention. Particularly, in FIG. 3A, the folding part 130 filled with the transparent resin material is provided between the first window 110 and the second window 120, and the transparent resin layer 150 is formed on the front surface of each of the first window 110 and the second window 120 by continuing to the folding part 130, in FIG. 3B, the folding part 130 is first filled with the transparent resin material, and the transparent resin layer 150 made of a resin material harder than the transparent resin material is formed on the entirety of the front surface of each of the first window 110 and the second window 120, and in FIG. 3C, the transparent resin layer 150 is formed on the back surface of each of the first window 110 and the second window 120.

Here, each of the end part of the first window 110 and the end part of the second window 120 in contact with the folding part 130 has the polished surface. Accordingly, the reflection of the boundary surface is minimized to deteriorate the visibility of the boundary surface.

Figure 4:
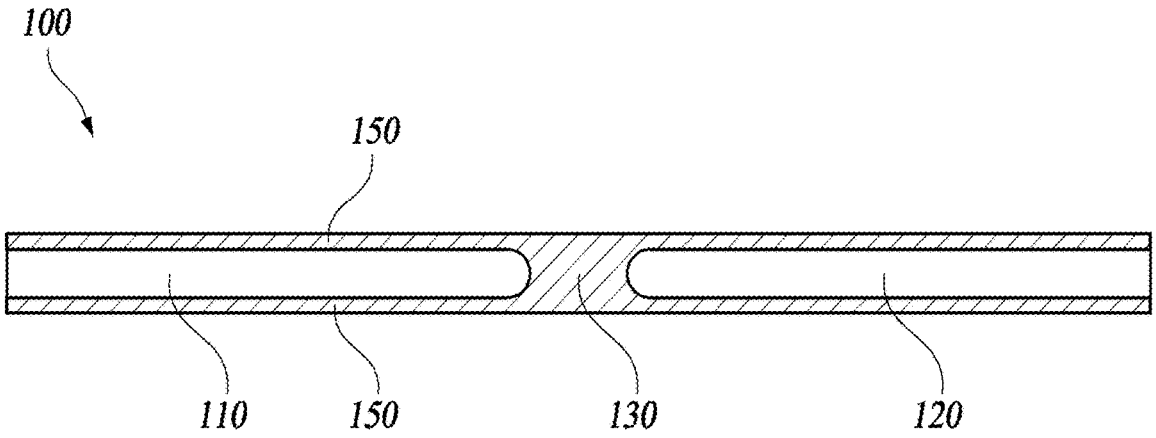

FIG. 4 illustrates a case in which the transparent resin layer 150 of the embodiment of FIGS. 3A to 3C is formed on the opposite surfaces of each of the first window 110 and the second window 120, that is, on the front surface and the back surface thereof according to an embodiment of the present invention.

Figure 5A:
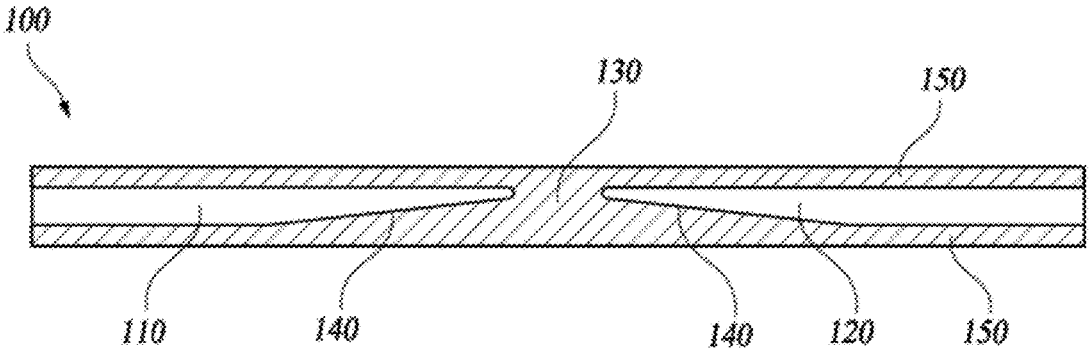
Figure 5B:
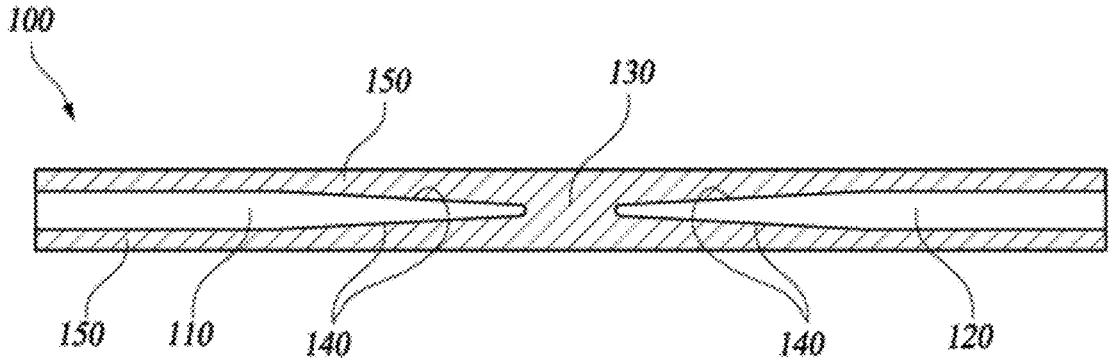

FIGS. 5A and 5B illustrate the inclined part 140 provided to be adjacent to the folding part 130 and to have a thickness gradually becoming smaller toward the folding part 130 according to an embodiment of the present invention. Particularly, FIG. 5A illustrates a case in which the inclined part 140 is formed only on the back surface of each of the first window 110 and the second window 120, and FIG. 5B illustrates a case in which the inclined part 140 is formed on the front surface and the back surface of each of the first window 110 and the second window 120.

FIGS. 6A and 6B illustrate the transparent resin layer 150 formed on the total surface of the front surface of each of the first window 110 and the second window 120, the transparent resin layer 150 being formed of a material different from the transparent resin material, with which the folding part 130 is filled, for example, a resin material harder than the transparent resin material, with which the folding part is filled, in the embodiment of FIGS. 5A and 5B.

Figure 8:
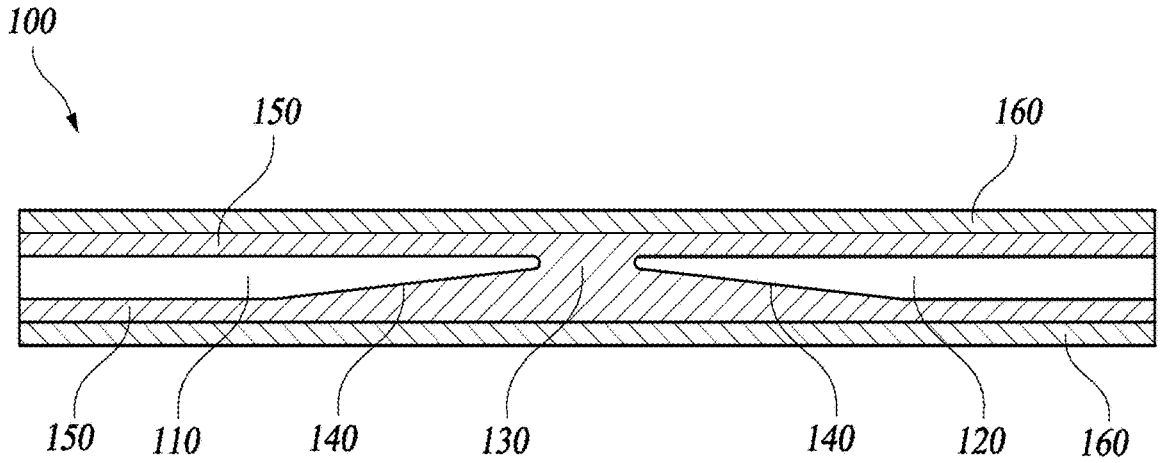

FIG. 7 illustrates a case in which the functional coating layer 160 is added to the back surface in FIG. 5A according to an embodiment of the present invention, and FIG. 8 illustrates a case in which the functional coating layer 160 is added to each of the front surface and the back surface in FIG. 5A according to an embodiment of the present invention.

Figure 9:
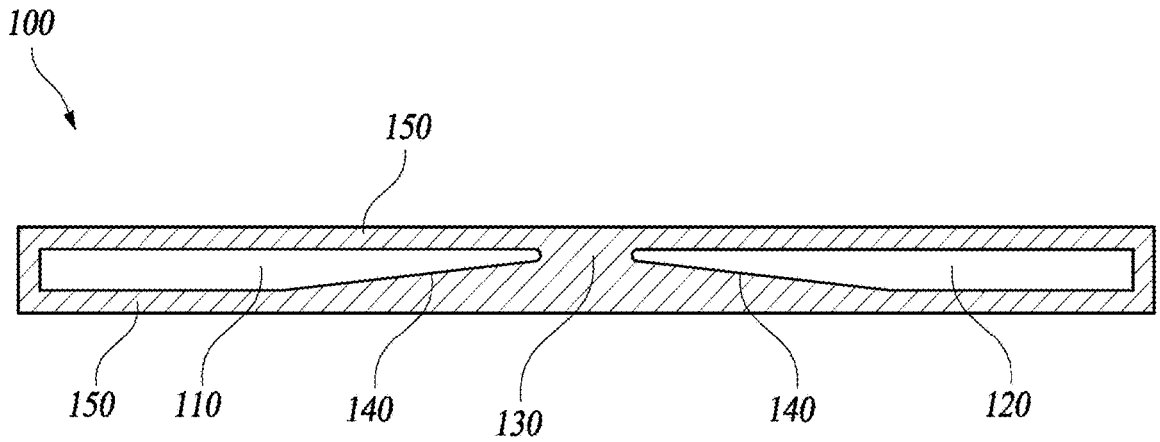

FIG. 9 illustrates a case in which the transparent resin layer 150 according to the present invention is formed on the total surface of the front, back, and side surfaces to completely cover the first window 110 and the second window 120 inside the transparent resin layer 150 according to an embodiment of the present invention.

Accordingly, the present invention relates to the flexible cover window, and more particularly, provides the flexible cover window, in which the visibility of the boundary part of the folding part, that is, the visibility of the boundary part to the naked eye due to the reflection of the boundary surface of glass is minimized, and strength and folding properties are secured.

In addition, the flexible cover window according to the present invention is made of the composite material of glass and the resin material, so that flexibility, resilience, elasticity, and strength properties are reinforced due to the resin material while the texture of glass is maximally maintained.

Furthermore, according to the flexible cover window of the present invention, the limitation of the thickness of the folding part due to the use of the existing glass is minimized due to the use of the composite material of glass and the resin material, so folding and strength properties are improved.

Accordingly, since there is no limitation of the thickness in the folding part, stress difference due to difference of the thickness of glass between a plane area and a folding area can be overcome, so the distortion of a screen or the deterioration of the resolution and durability thereof can be minimized and thus a high quality flexible display can be provided.

What is claimed is:

1. A flexible cover window for a flexible display, the flexible cover window comprising:

a first window made of glass and provided on an upper part of a first surface of the flexible display;

a second window made of glass and provided on an upper part of a second surface of the flexible display; and a folding part provided between the first window and the second window by corresponding to a folding area of the flexible display and filled with a transparent resin material, wherein a transparent resin layer is provided on a total surface of each of the first window and the second window by continuing to the folding part filled with the transparent resin material, wherein each of an end part of the first window and an end part of the second window, which are in contact with the folding part, has a polished surface.

2. The flexible cover window of claim 1, wherein each of the first window and the second window has an inclined part configured to have a thickness gradually becoming smaller toward the folding part.

3. The flexible cover window of claim 2, wherein the inclined part is provided on a surface or opposite surfaces of each of the first window and the second window.

4. The flexible cover window of claim 2, wherein inclination of the inclined part is 1~10° relative to a horizontal direction of the cover window.

5. The flexible cover window of claim 1, wherein the transparent resin layer is provided on a surface of each of the first window and the second window, or on a total surface of opposite surfaces thereof, or on a total surface of front, back, and side surfaces thereof to completely cover the first window and the second window inside the transparent resin layer.

6. The flexible cover window of claim 5, wherein in the transparent resin layer, the transparent resin layer provided on the back surface of each of the first window and the second window is made of a material softer than a material of the transparent resin layer provided on the front surface of each of the first window and the second window.

7. The flexible cover window of claim 1, further comprising:

a functional coating layer provided on a surface or opposite surfaces of the cover window.

8. The flexible cover window of claim 7, wherein the functional coating layer is configured as a single layer or multiple layers.

9. The flexible cover window of claim 8, wherein the functional coating layer provided on a front surface of the cover window is embodied as a strength reinforcement layer, and the functional coating layer provided on a back surface of the cover window is embodied as an elastic reinforcement layer.

10. The flexible cover window of claim 9, wherein when the functional coating layer provided on the front surface of the cover window is configured as multiple layers, the functional coating layer is made of a material becoming harder upward.

11. The flexible cover window of claim 10, wherein the functional coating layer provided on an uppermost layer is given an anti-finger (AF) or an anti-reflective (AR) function.

12. The flexible cover window of claim 1, wherein a thickness of each of the first window and the second window is 20 to 50 μm.

13. The flexible cover window of claim 1, wherein the cover window satisfies a minimum curvature radius of 0.5 to 2.5 mm during folding.

14. The flexible cover window of claim 1, wherein a width ($W_1$) of the folding part is 3.0 to 8.0 mm.

15. A flexible cover window for a flexible display, the flexible cover window comprising:

a first window made of glass and provided on an upper part of a first surface of the flexible display;

a second window made of glass and provided on an upper part of a second surface of the flexible display; and a folding part provided between the first window and the second window by corresponding to a folding area of the flexible display and filled with a transparent resin material, wherein a transparent resin layer is provided on a total surface of each of the first window and the second window by continuing to the folding part filled with the transparent resin material, wherein each of the first window and the second window has an inclined part configured to have a thickness gradually becoming smaller toward the folding part, and wherein the inclined part is provided by any one process of wet etching, polishing, laser forming, and masking processes, or by a process of combining at least two processes thereof, or by the wet etching, the laser forming, or the masking process, which is followed by the polishing process.

16. A flexible cover window for a flexible display, the flexible cover window comprising:

a first window made of glass and provided on an upper part of a first surface of the flexible display;

a second window made of glass and provided on an upper part of a second surface of the flexible display; and a folding part provided between the first window and the second window by corresponding to a folding area of the flexible display and filled with a transparent resin material, wherein a transparent resin layer is provided on a total surface of each of the first window and the second window by continuing to the folding part filled with the transparent resin material, and wherein the transparent resin material is an optical clear resin (OCR).

17. The flexible cover window of claim 16, wherein each of the first window and the second window has an inclined part configured to have a thickness gradually becoming smaller toward the folding part.

18. The flexible cover window of claim 17, wherein inclination of the inclined part is 1~10° relative to a horizontal direction of the cover window.

19. The flexible cover window of claim 16, further comprising:

a functional coating layer provided on a surface or opposite surfaces of the cover window.

20. The flexible cover window of claim 19, wherein the functional coating layer provided on a front surface of the cover window is embodied as a strength reinforcement layer, and the functional coating layer provided on a back surface of the cover window is embodied as an elastic reinforcement layer.

* * * * *